US006764033B2

(12) United States Patent
Dantes et al.

(10) Patent No.: US 6,764,033 B2
(45) Date of Patent: Jul. 20, 2004

(54) SWIRL PLATE AND FUEL INJECTION VALVE COMPRISING SUCH A SWIRL PLATE

(75) Inventors: Guenter Dantes, Eberdingen (DE); Detlef Nowak, Untergruppenbach (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/111,470

(22) PCT Filed: Aug. 21, 2001

(86) PCT No.: PCT/DE01/03106

§ 371 (c)(1),
(2), (4) Date: Jul. 17, 2002

(87) PCT Pub. No.: WO02/16758

PCT Pub. Date: Feb. 28, 2002

(65) Prior Publication Data

US 2002/0179740 A1 Dec. 5, 2002

(30) Foreign Application Priority Data

Aug. 23, 2000 (DE) ..... 100 41 440

(51) Int. Cl.[7] ..... B05B 1/00

(52) U.S. Cl. ..... 239/596; 239/552; 239/494; 239/585.1

(58) Field of Search ..... 239/596, 552, 239/494, 584, 533.12, 466, 487, 585.1, 900

(56) References Cited

U.S. PATENT DOCUMENTS 2,920,831 A * 1/1960 Johnsyn et al. ..... 239/464
3,081,952 A * 3/1963 Woodward et al. ..... 239/464
3,326,470 A * 6/1967 Loudin et al. ..... 239/404
RE33,841 E * 3/1992 Rush et al. ..... 239/543
5,178,331 A * 1/1993 Schuerz ..... 239/405
5,570,841 A * 11/1996 Pace et al. ..... 239/585.1
5,766,441 A * 6/1998 Arndt et al. ..... 205/170
5,785,254 A * 7/1998 Zimmermann et al. ..... 239/490
6,050,507 A * 4/2000 Holzgrefe et al. ..... 239/585.1
6,089,473 A * 7/2000 Keim ..... 239/533.12
6,161,782 A * 12/2000 Heinbuck et al. ..... 239/585.1
6,170,763 B1 * 1/2001 Fuchs et al. ..... 239/533.12
6,170,764 B1 * 1/2001 Muller et al. ..... 239/533.12
6,230,992 B1 * 5/2001 Arndt et al. ..... 239/585.1
6,341,592 B2 * 1/2002 Okamoto et al. ..... 123/305
6,382,533 B1 * 5/2002 Mueller et al. ..... 239/585.1
6,405,935 B2 * 6/2002 Dantes et al. ..... 239/5
6,405,945 B1 * 6/2002 Dobrin ..... 239/463
2003/0121998 A1 * 7/2003 Maier et al. ..... 239/585.1

FOREIGN PATENT DOCUMENTS

DE 04 054 272 2/1992
DE 196 07 288 10/1996
DE 196 37 103 3/1998

* cited by examiner

*Primary Examiner*—Henry Bennett
*Assistant Examiner*—Amanda Flynn
(74) *Attorney, Agent, or Firm*—Kenyon & Kenyon

(57) ABSTRACT

A swirl disk distinguishes itself in that it has at least one inlet region and at least one outlet opening, the at least one outlet opening being introduced in a bottom base layer. The swirl disk also has at least two swirl channels, which empty into a swirl chamber, the swirl chamber being provided in a swirl-generating layer. The swirl channels being situated and positioned such that when a fluid flows through, at least two swirl flows are generated next to one another in opposite directions, each one having its own jet branch. The swirl disk is particularly suitable for use on a fuel injector, in particular a high-pressure injector for directly injecting fuel into a combustion chamber of a mixture-compressing, spark-ignition internal combustion engine.

15 Claims, 2 Drawing Sheets

SWIRL PLATE AND FUEL INJECTION VALVE COMPRISING SUCH A SWIRL PLATE

FIELD OF THE INVENTION

The present invention relates to a swirl disk and to a fuel injector.

BACKGROUND INFORMATION

An electromagnetically operable fuel injector in which a swirl-generating element is provided upstream from a valve seat is described in German Published Patent Application No. 196 37 103. The swirl-generating element is formed such that at least two flows of fuel are able to be generated that are radially offset from one another and run in a mutually enclosing or encircling manner in different directions. The system for generating the spray jet, which is made up of an inner and an outer flow having different orientations, and including flow paddles or multilayer swirl attachments as guiding elements on an orifice plate is quite complicated and is comparably expensive to produce. The swirl-generating element is designed such that either a swirling full-cone stream or a swirling hollow-cone stream emerges from the fuel injector.

The so-called multilayer electroplating for producing orifice plates that are particularly suitable for use in fuel injectors are described in German Published Patent Application No. 196 07 288. This manufacturing principle is for producing disks using multiple electroplating metal deposition of different patterns on one another, so that a one piece disk results. The micro-electroplating metal deposition in several surfaces or layers may also be used for producing the swirl plates of the present invention.

SUMMARY OF THE INVENTION

The swirl disk of the present invention has the advantage that it is able to be inexpensively produced in a particularly simple manner. A particular advantage is that the swirl disks are able to be produced simultaneously and extremely precisely in large numbers in a reproducible manner (high batch capability). Using the one-piece swirl disk of the present invention, it is possible to produce a swirling dual-jet characteristic of a spray device, in particular of a fuel injector, without any additional supplementary attachments or other auxiliary swirl-generating means.

It is particularly advantageous to produce the swirl disk using so-called multilayer electroplating. Due to their metallic design, such swirl disks are unbreakable and easily mountable, e.g. on injectors or other spray nozzles for fluids of any type. Using multilayer electroplating permits an extremely large freedom of design since the contours of the opening regions (inlet regions, swirl channels, swirl chambers, outlet openings) in the swirl disk may be freely selected. This flexible form design is advantageous especially in comparison with silicon disks, which have strictly defined attainable contours (truncated pyramid) due to the crystal axes.

Metallic deposition has the advantage of a particularly large material diversity especially in comparison with producing silicon disks. The most different metals having different magnetic properties and hardnesses may be employed in the micro-electroplating used for producing swirl disks.

It is particularly advantageous to construct the swirl disk including three layers by performing two or three electroplating steps for the metal deposition. In this context, the upstream layer represents a cover layer that completely covers the swirl chamber of a middle swirl-generating layer. The swirl-generating layer is formed by a plurality of material regions that form the contours of the swirl chamber and of the swirl channels due to their shaping and their geometric position with respect to one another. As a result of the electroplating process, the individual layers are built up on top of one another without separation points or joining points such that represent a continuously homogenous material. In this respect, the "layers" are to be understood as a mental aid.

In an advantageous manner, at least two, but also four or six swirl channels with which at least two different swirl directions are produced in the fuel are provided in the swirl disk. The material regions may have very different forms depending on the desired shaping of the swirl channels.

The fuel injector of the present invention has the advantage that a particularly high spray quality of a fuel to be sprayed as well as a desired double jet formation are achieved in a very simple manner for certain installation conditions and combustion-chamber designs. Therefore, the fuel injector of the present invention makes it possible to achieve a swirling dual-jet characteristic, the two jet branches forming a double swirl with their opposing swirl direction. As a result, an injector of an internal combustion engine allows among other things the exhaust-gas emission of the internal combustion engine as well as the fuel consumption to be reduced.

An example embodiment of a swirl disk includes a structure including a complete passage for a fluid, at least one inlet region, at least one outlet opening, a bottom base layer in which the at least one outlet opening is introduced, at least two swirl channels that empty into a swirl chamber, and a swirl-generating layer into which the swirl chamber is provided. The at least two swirl channels may be situated and positioned such that when a fluid flows through, at least two swirl flows are generated next to one another in opposite directions, each one forming its own jet branch, and the at least one outlet opening may be designed in the shape of an 8.

An example embodiment of a fuel injector for a fuel injection system of an internal combustion engine includes a longitudinal valve axis, an actuator, a fixed valve seat formed at a valve seat element, a movable valve part that cooperates with the fixed valve seat to open and close a valve, and a swirl disk situated downstream from the fixed valve seat and having a multilayer design. The swirl disk may include at least one inlet region and at least one outlet opening, the at least one outlet opening may be introduced in a bottom base layer of the swirl disk, the swirl disk may include a swirl chamber and at least two swirl channels that empty into the swirl chamber and are upstream from the at least one outlet opening, the at least two swirl channels may be situated and positioned such that when a fluid flows through, at least two swirl flows are generated next to one another in opposite directions, each one having its own jet branch, and the at least one outlet opening may be designed in the shape of an 8.

Corresponding advantages for the use on a fuel injector may be derived in a logical manner from the advantages specified with regard to the swirl disks since the simplified and particularly easily reproducible manufacturing method of the swirl disks in connection with the high functionality of the swirl production in fluid, fuel in this case, for the fuel injector also result in the advantages of high quality, uniform fine spraying, high variability in the jet forms, and a reduction in cost.

DETAILED DESCRIPTION

Figure 1:
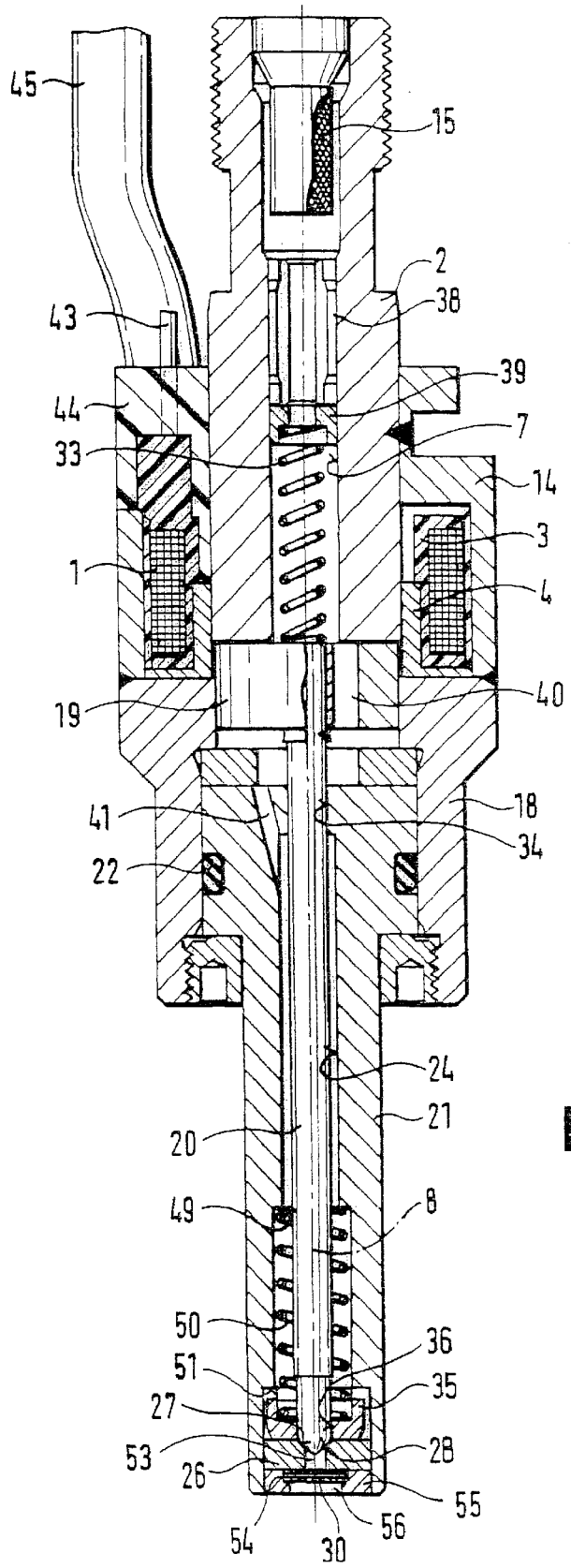
FIG. 1 shows a section of a fuel injector equipped with a swirl disk.

The electromagnetically operable valve shown by way of example in FIG. 1 in the form of an injection valve for fuel injection systems of mixture-compressing, spark-ignition internal combustion engines has a tubular, largely hollow cylindrical core 2, which is at least partially surrounded by a magnetic coil 1 and is used as an internal pole of a magnetic circuit. The fuel injector is particularly suitable as a high-pressure injector for directly injecting fuel into a combustion chamber on an internal combustion engine. An injector (for gasoline or diesel applications, for direct or manifold injection) represents only one important field of application for the swirl disk of the present invention subsequently described in more detail. These swirl disks may also be used in ink jet printers, in nozzles for spraying fluids of any type, or in inhalers. The swirl disks of the present invention are generally suited for producing fine sprays using swirl components.

A plastic coil shell 3, which is stepped, for example, accommodates a winding of magnetic coil 1 and in connection with core 2 and an annular, non-magnetic intermediate part 4, which is partially surrounded by magnetic coil 1, enables a particularly compact and short design of the injector in the region of magnetic coil 1.

Provided in core 2 is a continuous longitudinal opening 7, which extends along a longitudinal valve axis 8. Core 2 of the magnetic circuit is also used as a fuel intake nipple, longitudinal opening 7 representing a fuel supply duct. Fixedly connected to core 2 above magnetic coil 1 is an external, metal (e.g. ferretic) housing part 14, which closes the magnetic circuit as an external pole or an external conductive element and completely surrounds magnetic coil 1 at least in the circumferential direction. Provided on the incoming side in longitudinal opening 7 of core 2 is a fuel filter 15, which is responsible for filtering out such fuel components that could cause blockage or damage in the fuel injector due to their size.

Sealingly and securely connected to top housing part 14 is a bottom tubular housing part 18, which, for example, encircles or receives an axially movable valve part including an armature 19, a rod-shaped valve needle 20, and an elongated valve-seat support 21. Both housing parts 14 and 18 are securely connected to one another, for example, by a circumferential welded seam. Housing part 18 and valve-seat support 21 are sealed, e.g., by a sealing ring 22.

Bottom end of valve-seat support 21, which also represents the downstream connection of the entire fuel injector, surrounds a disk-shaped valve-seat element 26 fit into a through hole 24 and having a valve-seat surface 27, which tapers, for example, in a downstream direction in the shape of a truncated cone. Disposed in through opening 24 is a valve needle 20 having a valve-closure segment 28 at its downstream end. This valve-closure segment 28, which tapers conically, for example, cooperates in a known manner with valve-seat surface 27. Downstream from valve-seat surface 27, after valve-seat element 26 is a swirl disk 30 of the present invention, which is produced, for example, by multilayer electroplating and includes three metallic layers deposited on top of one another.

The fuel injector is actuated in a known manner, e.g. electromagnetically. The electromagnetic circuit including magnetic coil 1, core 2, housing parts 14 and 18, and armature 19 is used to axially move valve needle 20 and, consequently, to open the injector against the spring tension of a restoring spring 33 situated in longitudinal opening 7 of core 2 or to close it. A guide opening 34 provided in valve-seat support 21 at the end facing armature 19 and a disk-shaped guide element 35 situated upstream from valve-seat element 26 and having a dimensionally accurate guide opening 36 are used for guiding valve needle 20 during its axial movement by armature 19 along longitudinal valve axis 8.

Instead of the electromagnetic circuit, another energizable actuator, e.g. a piezo stack, may also be used in a comparable fuel injector or the axially movable valve part may be operated by a hydraulic pressure or servo pressure.

An adjusting sleeve 38 pushed, pressed, or screwed into longitudinal opening 7 of core 2 is used for adjusting the spring bias of a restoring spring 33, which at its upstream side abuts against adjusting sleeve 38 via a centering piece 39 and is supported at its opposite side on armature 19. Provided in armature 19 are one or more bore-like flow channels 40 through which the fuel is able to travel from longitudinal opening 7 in core 2 through connecting channels 41 formed downstream from flow channels 40 in the vicinity of guide opening 34 in valve-seat support 21 into through hole 24.

The lift of valve needle 20 is determined by the installed state of valve-seat element 26. In the case of magnetic coil 1 not being energized, an end position of valve needle 20 is established by valve-closure segment 28 contacting valve-seat surface 27, while, in response to magnetic coil 1 being energized, the other end position of valve needle 20 is reached by armature 19 contacting the downstream end face of core 2.

The electrical contacting of magnetic coil 1 and, consequently, its energization are carried out via contact elements 43, which are provided with a plastic extrusion coat 44 outside of coil shell 3 and proceed as connecting cable 45. Plastic extrusion coat 44 may also extend to additional components (e.g. housing parts 14 and 18) of the fuel injector.

A first shoulder 49 in through hole 24 is used as a contact surface for a compression spring 50, which may be spiral. A second step 51 creates an enlarged mounting space for the three disk-shaped elements 35, 26, and 30. Compression spring 50, which surrounds valve needle 20, biases guide element 35 in valve-seat support 21 since its side opposite shoulder 49 presses against guide element 35. Introduced downstream from valve-seat surface 27 in valve-seat element 26 is an outlet opening 53 through which the fuel flowing along valve-seat surface 27 when the valve is open flows to subsequently enter swirl disk 30. Swirl disk 30 is present, for example, in a recess 54 in a disk-shaped retaining element 55, retaining element 55 being securely connected to valve-seat support 21, e.g. by welding, gluing, or locking. Formed in retaining element 55 is a central outlet opening 56 through which the now swirled fuel exits the fuel injector in two jets.

Figure 2:
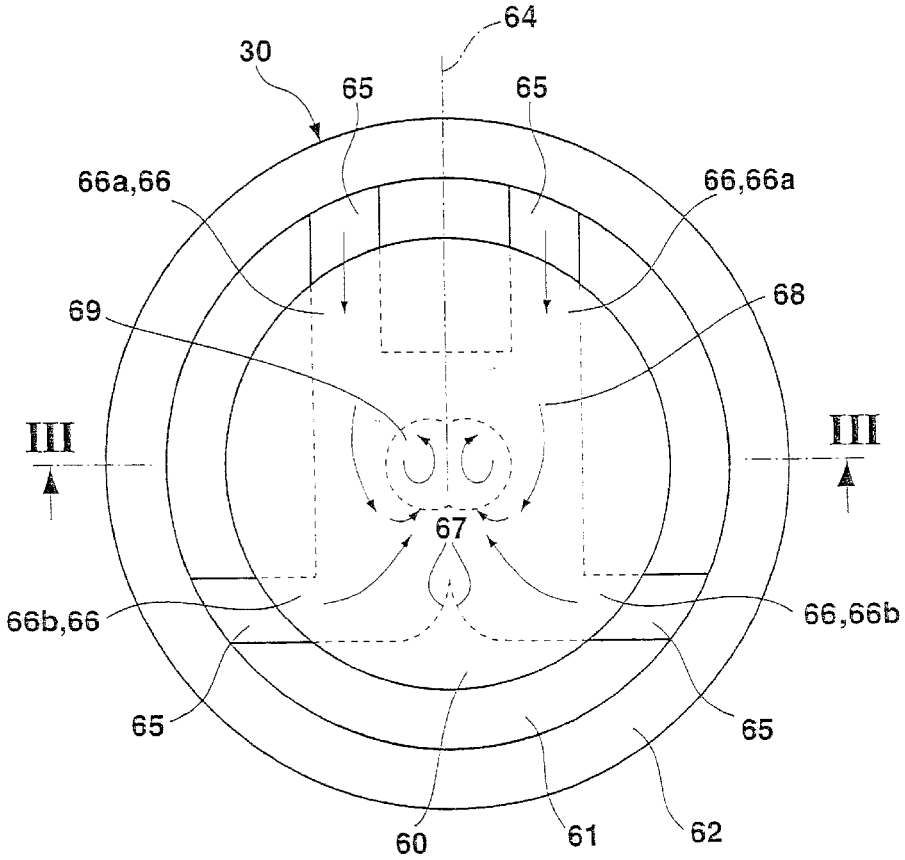
FIG. 2 shows a top view of a swirl disk of the present invention.
Figure 3:
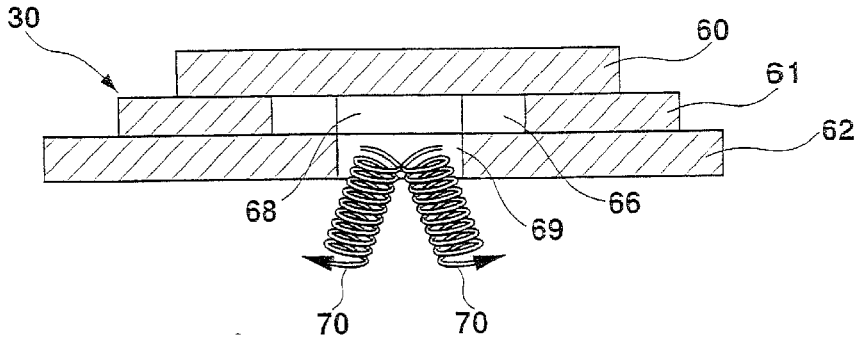
FIG. 3 shows a section along line III—III in FIG. 2.

FIG. 2 shows a top view of a swirl disk 30 of the present invention, while FIG. 3 shows a section along line III—III in FIG. 2.

Swirl disk 30 is formed from three surfaces or layers that are deposited by electroplating on top of one another and, consequently, axially follow one another in an installed state. In the following, the three layers of swirl disk 30 are designated according to their function as cover layer 60, swirl-generating layer 61, and base layer 62. Top cover layer 60 has a smaller outside diameter than swirl-generating layer 61, which in turn has a smaller outside diameter than base layer 62.

In this manner, it is ensured that the fuel flows outside past cover layer 60 and, therefore, is able to enter external inlet regions 65 of, for example, four swirl channels 66 in center swirl-generating layer 61. The arrows in FIG. 2 indicate the flow, the special configuration of swirl channels 66 making it noticeable that the swirl in the fuel is generated in opposite directions.

Top cover layer 60 represents a closed metallic layer having no opening regions for flow through, yet being able to be flowed around in a ring shape. However, provided in swirl-generating layer 61 is a complex opening contour that runs over the entire axial thickness of this layer 61. The opening contour of middle layer 61 is formed by an internal swirl chamber 68 and by a plurality (e.g. two, four, six, or eight) swirl channels 66 leading into swirl chamber 68. In the represented exemplary embodiment, swirl disk 30 has four swirl channels 66. Two adjacent swirl channels 66*a* run parallel to swirl chamber 68, while two other swirl channels 66*b* run at a 90° angle to swirl channels 66*a* and tangentially empty directly into swirl chamber 68 from opposite sides. In this context, the fuel flowing in each case in on one side of an imaginary symmetry axis 64 of swirl disk 30 via a swirl channel 66*a* and swirl channel 66*b* forms a flow component so that two flows are generated in opposite directions in swirl chamber 68. Both swirl channels 66*b* are provided, for example, with paddle-shaped extensions 67 to direct the flows to an outlet opening 69. Extensions 67 may be rounded off in a shovel-like manner.

While swirl chamber 68 is completely covered by cover layer 60, swirl channels 66 are only partially covered since the external ends away from swirl chamber 68 form upwardly open inlet regions 65.

The rotational pulse impressed on the fuel is also maintained in center outlet opening 69 of bottom base layer 62. In this context, the two opposing flows that result in two jet branches 70 when sprayed are also maintained. The two flows meet in swirl chamber 68 just prior to outlet opening 69 or in outlet opening 69. The two flows rotate at the direct point of contact in the same direction, so that immediately following they push away from one another and increase the desired dual jet characteristic.

The diameter of the, for example, 8-shaped outlet opening 69 is significantly smaller than the opening diameter of the swirl chamber 68 directly above it. As a result, the swirl intensity generated in swirl chamber 68 in increased. Instead of the one outlet opening 69, two outlet openings 69 situated close together and ultimately separated by a crosspiece may also be provided. Then one flow (jet branch 70) having a swirl direction opposite to the corresponding other flow is emitted from every outlet opening 69. The jet form is able to be adjusted using the distance between the two outlet openings 69.

Swirl disk 30 is built up in a plurality of metallic layers, e.g. by electrodeposition (multilayer electroplating). The deep-lithographic production using electroplating technology results in particular features in the shaping of which several are briefly indicated here:

- layers having a constant thickness over the disk surface;
- substantially vertical cuts in the layers that form the hollow spaces flowed through in each case as a result of the deep-lithographic structuring (deviations of about 3° with respect to optimally vertical walls may occur as a function of production engineering);
- desired undercuts and overlappings of the cuts due to multilayer design of individually patterned metal layers;
- cuts having any cross sectional forms having largely axially parallel walls;
- one-piece design of the swirl disk since the individual metal deposits occur in immediate succession.

In the following sections, the method for producing swirl disks 30 is only explained briefly. All method steps of the electroplating metal deposition for producing an orifice plate are already described in detail in DE OS 196 07 288. It is characteristic for the method for the successive use of photolithographic steps (UV depth lithography) and subsequent micro-electroplating that a high precision of the patterns is ensured even on a large scale so that it is able to be ideally used for mass production with particularly large piece numbers (high batch capacity). A plurality of swirl disks 30 may be simultaneously produced on a panel or wafer.

The starting point for the method is a flat and stable supporting plate that may be made of metal (titanium, steel), silicon, glass, or ceramic, for example. At least one auxiliary layer is optionally first deposited on the supporting plate. In this context, the auxiliary layer is, for example, an electroplated starting layer (e.g. TiCuTi, CrCuCr, Ni) that is needed for the electrical conducting for the later micro-electroplating. The auxiliary layer is deposited, for example, by sputtering or by currentless metal deposition. After this pretreatment of the supporting plate, a photoresist is applied to the entire surface of the auxiliary layer, e.g. by rolling or spinning on.

In this context, the thickness of the photoresist should correspond to the thickness of the metal layer to be produced in the later electroplating process, i.e., the thickness of bottom base layer 62 of swirl disk 30. The resist layer may be made of one or more layers of a film able to be photo-structured or of a fluid resist (polyimide, photoresist). If an optional sacrificial layer is to be electroplated into the later produced resist patterns, the thickness of the photoresist is to be increased by the thickness of the sacrificial layer. The metal pattern to be produced is to be inversely transferred to the photoresist with the help of a photolithographic mask. One possibility is to expose the photoresist directly via the mask using UV exposure (printed-circuit board exposing means or semiconductor exposing means) (UV depth lithography) and to subsequently develop it.

The negative pattern ultimately produced in the photoresist for subsequent layer 62 of swirl disk 30 is filled with metal (e.g. Ni, NiCo, NiFe, NiW, Cu) by electroplating (metal deposition). Due to the electroplating, the metal lies close to the contour of the negative pattern, so that the defined contours are reproduced true to form. To produce the structure of swirl disk 30, the steps starting from the optional deposition of an auxiliary layer are repeated according to the number of desired layers, so that for a three layer swirl disk 30, two (lateral overgrowth) or three electroplating steps are performed. Different metals may also be used for the layers of a swirl disk 30 yet are only able to be employed in each case in a new electroplating step.

After top cover layer 60 is deposited, the remaining photoresist is removed from the metal patterns by wet-chemical stripping. In the case of smooth, passivated supporting plates (substrates), swirl disks 30 are able to be detached and separated from the substrate. In the case of supporting plates having good adhesion of swirl disks 30, the sacrificial layer is selectively etched away from the substrate and swirl disk 30, thereby making it possible to lift and separate swirl disks 30 from the supporting plate.

What is claimed is:

1. A swirl disk, comprising:

a structure including:

a complete passage for a fluid, at least one inlet region, at least one outlet opening, a bottom base layer in which the at least one outlet opening is introduced, at least two swirl channels that empty into a swirl chamber, and a swirl-generating layer into which the swirl chamber is provided, wherein the at least two swirl channels are situated and positioned to generate and maintain a multi-stream spray discharge from a fluid flow therethrough, the multi-stream spray discharge including at least two swirl flows as independent multiple spray discharges that exit the structure at an angle to one another and next to one another in opposite directions, each one forming its own jet branch.

2. The swirl disk as recited in claim 1, wherein the swirl disk is for an injector.

3. The swirl disk as recited in claim 1, wherein the at least two swirl channels are directed toward one another.

4. The swirl disk as recited in claim 1, wherein the at least two swirl channels include four swirl channels, a first two of the four swirl channels run parallel to one another, and a second two of the four swirl channels run at an angle to the first two of the four swirl channels and tangentially empty directly into the swirl chamber from opposite sides.

5. The swirl disk as recited in claim 1, wherein the at least two swirl channels have extensions that are rounded off in a shovel-like manner.

6. The swirl disk as recited in claim 1, wherein the structure includes a top cover layer arranged over the swirl-generating layer, the top cover layer has a smaller outer diameter than the underlying swirl-generating layer and the bottom base layer.

7. The swirl disk as recited in claim 1, wherein the layers of the swirl disk are built up directly on top of one another in an adhesive manner via electroplating metal deposition.

8. A fuel injector for a fuel injection system of an internal combustion engine, comprising:

a longitudinal valve axis;

an actuator;

a fixed valve seat formed at a valve seat element;

a movable valve part that cooperates with the fixed valve seat to open and close a valve; and a swirl disk situated downstream from the fixed valve seat and having a multilayer design, wherein:

the swirl disk includes at least one inlet region and at least one outlet opening, the at least one outlet opening is introduced in a bottom base layer of the swirl disk, the swirl disk includes a swirl chamber and at least two swirl channels that empty into the swirl chamber and are upstream from the at least one outlet opening, and the at least two swirl channels are situated and positioned to generate and maintain a multi-stream spray discharge from a fluid flow therethrough, the multi-stream spray discharge including at least two swirl flows as independent multiple spray discharges that exit the swirl disk at an angle to one another and next to one another in opposite directions, each one having its own jet branch.

9. The injector according to claim 8, wherein the injector is for directly injecting fuel into a combustion chamber of the internal combustion engine.

10. The injector as recited in claim 8, wherein the at least two swirl channels of the swirl disk are directed toward one another.

11. The fuel injector as recited in claim 8, wherein the swirl disk is designed such that a swirling dual-jet characteristic is generated in a fuel flowing through the swirl disk, the two jet branches resulting from a double swirl generated in the swirl disk.

12. A swirl disk, comprising:

a structure including:

a complete passage for a fluid, at least one inlet region, at least one outlet opening, a bottom base layer in which the at least one outlet opening is introduced, at least two swirl channels that empty into a swirl chamber, and a swirl-generating layer into which the swirl chamber is provided;

wherein the at least two swirl channels are situated and positioned such that when a fluid flows through, at least two swirl flows are generated next to one another in opposite directions, each one forming its own jet branch; and wherein the at least one outlet opening is designed in the shape of an 8.

13. A fuel injector for a fuel injection system of an internal combustion engine, comprising:

a longitudinal valve axis;

an actuator;

a fixed valve seat formed at a valve seat element;

a movable valve part that cooperates with the fixed valve seat to open and close a valve; and a swirl disk situated downstream from the fixed valve seat and having a multilayer design;

wherein the swirl disk includes at least one inlet region and at least one outlet opening;

wherein the at least one outlet opening is introduced in a bottom base layer of the swirl disk;

wherein the swirl disk includes a swirl chamber and at least two swirl channels that empty into the swirl chamber and are upstream from the at least one outlet opening;

wherein the at least two swirl channels are situated and positioned such that when a fluid flows through, at least two swirl flows are generated next to one another in opposite directions, each one having its own jet branch; and wherein the at least one outlet opening is designed in the shape of an 8.

14. A swirl disk, comprising:

a structure including:

a complete passage for a fluid, at least one inlet region, at least one outlet opening, a bottom base aver in which the at least one outlet opening is introduced, at least two swirl channels that empty into a swirl chamber, and a swirl-generating layer into which the swirl chamber is provided, wherein the at least two swirl channels are situated and positioned to generate and maintain a multi-stream spray discharge from a fluid flow therethrough, the multi-stream spray discharge including at least two swirl flows next to one another in opposite directions, each one forming its own jet branch; and wherein all of the at least two swirl channels are situated on the same plane.

15. A fuel injector for a fuel injection system of an internal combustion engine, comprising:

a longitudinal valve axis;

an actuator;

a fixed valve seat formed at a valve seat element;

a movable valve part that cooperates with the fixed valve seat to open and close a valve; and a swirl disk situated downstream from the fixed valve seat and having a multilayer design, wherein:

the swirl disk includes at least one inlet region and at least one outlet opening, the at least one outlet opening is introduced in a bottom base layer of the swirl disk, the swirl disk includes a swirl chamber and at least two swirl channels that empty into the swirl chamber and are upstream from the at least one outlet opening, the at least two swirl channels are situated and positioned to generate and maintain a multi-stream spray discharge from a fluid flow therethrough, the multi-stream spray discharge including at least two swirl flows next to one another in opposite directions, each one having its own jet branch, and all of the at least two swirl channels are situated on the same plane.

* * * * *